US010490347B2

(12) United States Patent
Mazaleyrat et al.

(10) Patent No.: US 10,490,347 B2
(45) Date of Patent: Nov. 26, 2019

(54) METHOD FOR PRODUCING A MONOLITHIC ELECTROMAGNETIC COMPONENT

(71) Applicants: Centre National De La Recherché Scientifique (C.N.R.S.), Paris (FR); Ecole Normale Superieure De Cachan, Cachan (FR)

(72) Inventors: Frédéric Mazaleyrat, Orsay (FR); Karim Zehani, Cachan (FR); Vincent Loyau, Paris (FR); Eric Laboure, Cachan (FR)

(73) Assignee: Centre National de la Recherche Scientifique (C.N.R.S.), Paris (FR)

( * ) Notice: Subject to any disclaimer, the term of this patent is extended or adjusted under 35 U.S.C. 154(b) by 277 days.

(21) Appl. No.: 14/914,599

(22) PCT Filed: Aug. 21, 2014

(86) PCT No.: PCT/EP2014/067852
§ 371 (c)(1),
(2) Date: Feb. 25, 2016

(87) PCT Pub. No.: WO2015/028389
PCT Pub. Date: Mar. 5, 2015

(65) Prior Publication Data

US 2016/0203908 A1 Jul. 14, 2016

(30) Foreign Application Priority Data

Aug. 26, 2013 (FR) ..... 13 58177

(51) Int. Cl.
*H01F 41/02* (2006.01)
*H01F 27/255* (2006.01)
(Continued)

(52) U.S. Cl.
CPC ..... *H01F 41/02* (2013.01); *H01F 41/0246* (2013.01); *H01F 1/344* (2013.01);
(Continued)

(58) Field of Classification Search
CPC .... H01F 1/344; H01F 27/255; H01F 27/2871; H01F 27/324; H01F 41/02; H01F 41/0246
See application file for complete search history.

(56) References Cited

U.S. PATENT DOCUMENTS 3,255,512 A * 6/1966 Lochner ..... H01F 27/022 29/602.1
5,062,197 A * 11/1991 Ngo ..... H01F 3/10 29/606
(Continued)

FOREIGN PATENT DOCUMENTS

JP 2010-177319 A 8/2010

OTHER PUBLICATIONS

International Search Report dated Sep. 17, 2014 for International Application No. PCT/EP2014/067852.
(Continued)

*Primary Examiner* — Minh N Trinh
(74) *Attorney, Agent, or Firm* — Knobbe, Martens, Olson & Bear, LLP

(57) ABSTRACT

A method for producing a monolithic electromagnetic component includes preparing a precursor from a ferrite material during an initial step; preparing elements including at least one coil having coil turns; embedding the elements including at least one coil having the coil turns in the precursor embedded in a mold; co-sintering the elements including at least one coil having the coil turns and the precursor compressed by the mold under a predetermined pressure, the predetermined pressure being generated under a load,
(Continued)

wherein a pulsed electric current is generated during the co-sintering; discharging the pulsed electric current through the mold such that a temperature in the mold rises; and obtaining the monolithic electromagnetic component in which the precursor is secured to the elements including at least one coil having the coil turns.

14 Claims, 8 Drawing Sheets

(51) Int. Cl.
*H01F 27/28* (2006.01)
*H01F 27/32* (2006.01)
*H01F 1/34* (2006.01)

(52) U.S. Cl.
CPC ..... *H01F 27/255* (2013.01); *H01F 27/2871* (2013.01); *H01F 27/324* (2013.01)

(56) References Cited

U.S. PATENT DOCUMENTS 5,087,804 A * 2/1992 McGaffigan ..... H05B 6/106 219/618
6,162,311 A * 12/2000 Gordon ..... H01F 17/062 156/250
6,594,157 B2 * 7/2003 Yoshida ..... H01F 1/15308 148/304
6,661,328 B2 * 12/2003 Inoue ..... H01F 1/24 29/602.1
7,879,269 B1 * 2/2011 Dening ..... C04B 35/26 252/62.56
8,695,208 B2 * 4/2014 Matz ..... H01F 17/0013 29/602.1
2007/0069426 A1 * 3/2007 Kurita ..... H01F 41/0273 264/428
2010/0194511 A1 * 8/2010 Kobayashi ..... H01F 17/04 336/83
2012/0013429 A1 * 1/2012 Kim ..... H01F 1/344 336/200
2013/0280520 A1 * 10/2013 Pan ..... C09K 11/7792 428/331

OTHER PUBLICATIONS

Mazaleyrat, et al., "XXIst Century Ferrites," Jounal of Physics: Conference Series, Institute of Physics Publishing, Bristol, GB, vol. 365, No. 1, May 18, 2012, p. 12001, XP020223227.
Mazaleyrat, et al., "Introduction M ferrite W ferrites Ni—Zn—Cu spinnel ferrites XXIst Century ferrites," May 8, 2012, XP055107296.

* cited by examiner

METHOD FOR PRODUCING A MONOLITHIC ELECTROMAGNETIC COMPONENT

INCORPORATION BY REFERENCE TO ANY PRIORITY APPLICATIONS

This application in the U.S. National Phase of International Application No. PCT/EP2014/067852, filed Aug. 21, 2014, designating the U.S. and claiming priority to French Application No. 13 58177, filed Aug. 26, 2013. Any and all applications for which a foreign or domestic priority claim is identified here or in the Application Data Sheet as filed with the present application are hereby incorporated by reference under 37 CFR 1.57.

The present invention relates to a method for producing monolithic electromagnetic components.

More specifically, the invention relates to a method for producing a monolithic electromagnetic component comprising several elements including a magnetic core of spinel ferrite and at least one planar coil comprising several turns.

Recent research in power electronics has focused on the miniaturization of converters and electronic components that they comprise, in particular decreasing the size of the active and passive components.

In this context, there is a need for monolithic components able to be integrated as closely as possible with semiconductors and to transfer increasingly significant power densities, i.e., to work at a higher frequency and discharge heat more effectively.

In a known manner, some spinel ferrites are used to manufacture this type of component by conventional sintering at temperatures of approximately 950° C. The ferrites obtained then have good performance levels up to several hundred megahertz, owing to a high resistivity.

However, producing monolithic electronic components from these ferrites using the known methods is only possible with coils made up of noble metals such as silver or palladium, which makes it expensive to produce large quantities of these power components. Furthermore, the known manufacturing methods involve many separate steps carried out on separate premises, and sometimes cause delamination, cracks in the materials or diffusions of material at the interfaces between the metal and the oxides.

One aim of the present invention is to propose a method for producing a monolithic electromagnetic component that does not have these drawbacks.

To that end, the invention relates to a method of the aforementioned type, characterized in that it comprises the following series of steps:

- during an initial step, a precursor of the ferrite is obtained,
- during a preparation step, in a mold, the elements of the monolithic electromagnetic component, including said at least one coil and other than the ferrites, are submerged in the precursor, and
- during a co-sintering step, said precursor is secured with the other elements of the monolithic electromagnetic component, including said at least one coil, by co-sintering under a load by pulsed electric current.

According to other embodiments, the method according to the invention comprises one or more of the features below, considered alone or according to any technically possible combination(s):

- the or each coil is made from copper;
- the ferrite has a composition with formula $Ni_xZn_{1-x-y-\epsilon+\delta}Cu_yCo_\epsilon Fe_{2-\delta}O_4$, with:
  - $0.15 \le x \le 0.6$;
  - $0 < y \le 0.2$;
  - $0 \le \epsilon \le 0.1$; and
  - $0 \le \delta \le 0.05$;
- the precursor is a ferrite powder having a spinel phase formed and obtained by successive grinding and calcination operations of the mixture of nanometric oxides, said calcination being done at a temperature comprised between 600° C. and 1100° C.;
- the precursor is a mixture of nanometric oxides not having a formed spinel phase;
- one of the elements of the monolithic electromagnetic component is a dielectric material;
- the turns of the or each coil have a general circular spiral or square spiral shape;
- during the preparation step, a first precursor layer of the ferrite is deposited in the mold, then the other elements of the monolithic electromagnetic component are arranged, including the or each coil, then a second precursor layer is deposited;
- the co-sintering step also comprises the following steps:
  - a compression step, during which the mold is subjected to a uniaxial pressure comprised between 50 and 100 MPa, and
  - a discharge step, during which an electric current with an intensity comprised between 1 A and 20,000 A, and preferably between 1 A and 1,000 A or between 1 and 10 A per square millimeter of component surface, is delivered through the mold, such that the temperature in the mold rises and the elements of the monolithic electromagnetic component become secured to one another;
- the discharge step comprises a co-sintering plateau during which the temperature inside the mold is kept between 650° C. and 850° C., preferably between 700° C. and 800° C., for a duration comprised between 1 min. and 30 min.; and
- the discharge step also comprises a first reaction plateau during which the temperature in the mold is comprised between 400° C. and 600° C., and during which the spinel phase of the precursor forms.

The invention further relates to a monolithic electromagnetic component, characterized in that it can be produced using a production method as defined above.

According to other embodiments, the component according to the invention comprises one or more of the features below, considered alone or according to any technically possible combinations(s):

- the turns of the or each coil are directly embedded in the ferrite;
- two successive turns of the or each coil define a radial interstice of the or each coil, and in that the interstices of the or each coil are at least partially filled with dielectric material;
- the or each coil has an inner turn and an outer turn respectively defining an inner discoid portion and an outer discoid portion of the monolithic electromagnetic component, the inner and/or outer discoid portions of the monolithic electromagnetic component being at least partially filled with dielectric material; and
- the component has a general cylinder shape, the diameter of which is comprised between 5 and 50 mm and the height of which is comprised between 1 and 20 mm.

The invention will be better understood upon reading the following detailed description, done solely for information and non-limitingly, and in reference to the appended drawings, in which.

Figure 9:
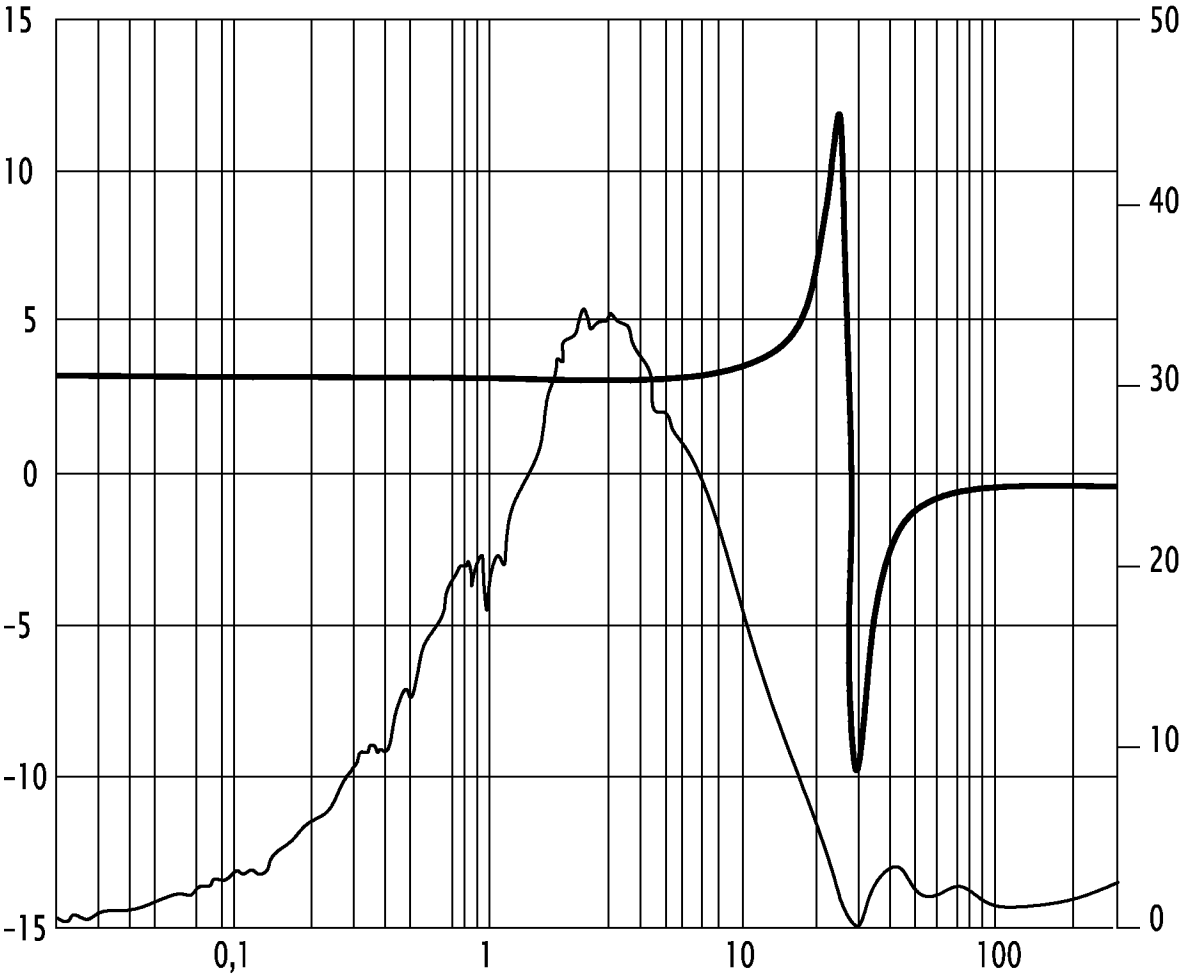
Figure 10:
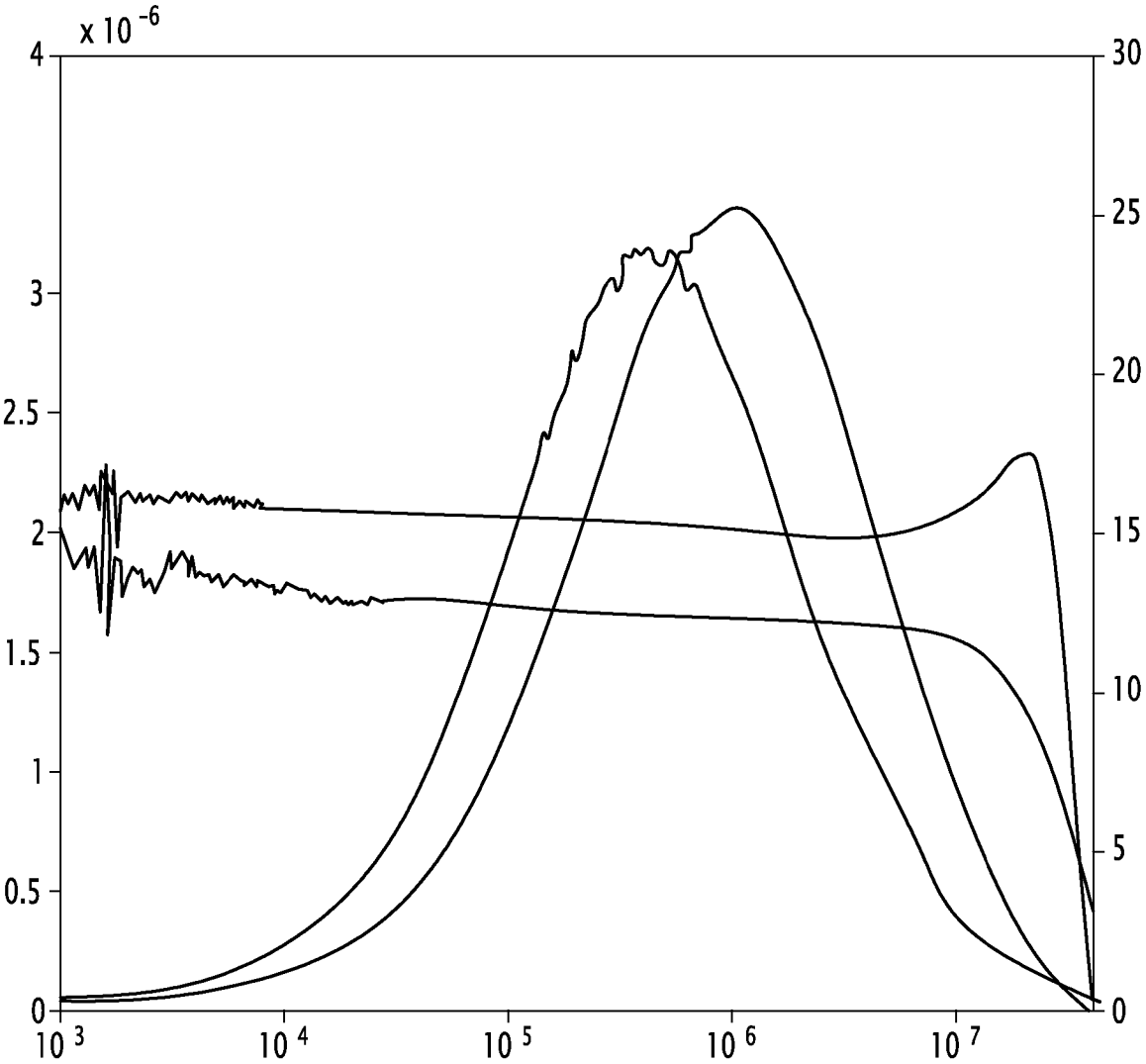

FIG. 9 is a diagram of an illustration of the measurement of the inductance and the overvoltage coefficient as a function of the frequency of a monolithic electromagnetic component according to the invention; and FIG. 10 is a diagram of an illustration of the inductance of the primary and the secondary and the overvoltage coefficient of a monolithic electromagnetic component according to the invention.

In reference to FIG. 1, a monolithic electromagnetic component with general reference 10 according to the invention, hereinafter component 10, comprises a base 12, a coil 14 arranged in the base 12, and an electrically insulating dielectric material 15.

Figure 1:
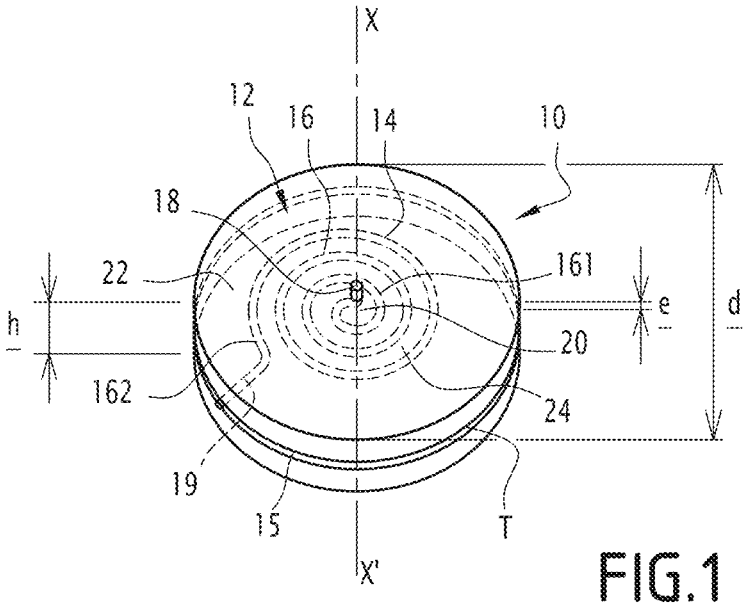
FIG. 1 is a diagrammatic illustration of a monolithic electromagnetic component according to the invention.

In the example of FIG. 1, the component 10 is an inductance designed to be used jointly with other electronic components, for example to produce power converters or filtering devices. Furthermore, it is designed to work in a given frequency band preferably comprised among the frequency range of 100 kHz-30 GHz. Lastly, it can be produced using the method according to the invention, as described below.

"Can be produced" means that the production method according to the invention and as described below makes it possible to obtain a component according to the invention, but it is not ruled out that another production method may exist or be discovered in the future that could also make it possible to obtain such a component.

The base 12 constitutes the most voluminous structure of the component 10 and gives it its general appearance.

The base 12 has a general cylindrical shape with longitudinal axis X-X', height h and diameter d.

In the example of FIG. 1, the height h is comprised between 1 and 2 mm, and the diameter d is comprised between 8 and 20 mm.

Alternatively, the diameter d is comprised between 5 and 50 mm, and the height h is comprised between 1 and 20 mm.

The base 12 has a high resistivity.

The base 12 is made from a spinel ferrite. Spinels are ferrites with the following general formula (G): $AB_{2-\delta}O_4$, where A has mean valence 2 and is an element or a combination of elements from the group of cations preferably formed by $Mg^{2+}$, $Ni^{2+}$, $Co^{2+}$, $Zn^{2+}$, $V^{2+}$, $Ti^{2+}$, $Sc^{2+}$, $Mn^{2+}$ and optionally $Fe^{2+}$, where B has mean valence 3 and is an element or combination of elements from the group of cations preferably formed by $Fe^{3+}$ and $Al^{3+}$, and where δ represents a potential material flaw. The material flaw δ can be introduced deliberately and is for example comprised between 0 and 0.05. Furthermore, spinel ferrites have the crystallographic structure of the reference compound $MgAl_2O_4$.

Preferably, the spinel ferrite of the component 10 has a composition with the following formula (1):

$$Ni_xZn_{1-x-y-\epsilon+\delta}Cu_yCo_\epsilon Fe_{2-\delta}O)_4, \text{ with } 0.15 \le x \le 0.6;\ 0 < y \le 0.2;\ 0 \le \epsilon \le 0.1 \text{ and } 0 \le \delta \le 0.05.$$

It has thus been observed that the components 10 whereof the ferrite of the base 12 had formula (1) had good results in terms of magnetic performance (low losses) in the frequency band between 300 kHz and 3 MHz in particular and densification during sintering at a low temperature (below 1000° C.).

As will be seen below, the ferrite 12 is obtained by densification of the mixture of nanometric oxides or by successive grinding and calcination of the mixture of nanometric oxides, the calcination being done at a temperature comprised between 600° C. and 1100° C.

For the components whereof the ferrite obeys formula (1), the nanometric oxides are zinc oxide ZnO, copper oxide CuO, nickel oxide NiO, cobalt oxide $Co_3O_4$ and iron oxide $Fe_2O_3$, the mixture also having a composition obeying formula (1).

Nanometric means that the particle size of the oxides can vary from several nanometers to several micrometers (approximately 5 μm at most). The particle size is then determined as a function of the frequency at which the component 10 is designed to operate.

In the example of FIG. 1, the diameter of the oxides used to produce the base 12 is comprised between 230 and 270 nm, and is substantially equal to 250 nm on average.

The coil 14 is able to allow the proper circulation of the electrical currents through it and to be secured to the ferrite of the base 12 by co-sintering.

Preferably, the coil 14 is made from copper.

Alternatively, it is made from a noble metal such as silver Ag or palladium Pd, or an alloy of palladium Pd, or an alloy of Palladium Pd and silver Ag.

The coil 14 is at least partially embedded in the ferrite of the base 12.

Still in reference to FIG. 1, the coil 14 comprises several turns 16, including an inner turn 161 and an outer turn 162.

In the example of FIG. 1, the turns 16 have a general circular spiral shape and have a substantially circular section.

Alternatively (not shown), the turns have a general square spiral shape.

The coil 14 also comprises an inner tab 18 and an outer tab 19, which make up bent ends of the inner turn 161 and outer turn 162, respectively.

The coil also has a non-zero thickness e, is substantially planar and is orthogonal to the axis X-X', such that the coil 14 is substantially comprised in a discoid edge T of the base 12, orthogonal to the axis X-X' and with thickness e.

The inner 161 and outer 162 turns respectively define an inner discoid portion 20 and an outer discoid portion 22 with thickness e of the edge T and the component 10.

Furthermore, two successive turns 16 of the coil 14 define a radial interstice 24.

FIGS. 2*a* to 2*d* show different embodiments of the component 10 according to the invention comprising a single coil 14.

In reference to FIG. 2*b*, in the embodiment of this Figure, the interstices 24, as well as the inner 20 and outer 22 discoid portions, are at least partially filled with dielectric material 15.

Only the upper and lower parts of the turns 16 of the coil 14 are in contact with the ferrite.

This embodiment advantageously makes it possible to limit the stray capacitances that may appear between the turns 16 during the operation of the component 10 via the electrical insulation resulting from the presence of the dielectric material 15.

In reference to FIG. 2*c*, in the embodiment of this Figure, the interstices 24 as well as the inner discoid portion 20 are at least partially filled with dielectric material 15, and the outer discoid portion 22 is filled with ferrite.

This embodiment is advantageously used in order to limit the stray capacitances that may appear between the turns 16 during the operation of the component 10, while minimizing the quantity of dielectric material 15 used.

In reference to FIG. 2*a*, in this embodiment, the component 10 has no dielectric material 15, the coil 14 thus being completely embedded in the ferrite of the base 12.

This alternative is advantageously used when the frequency at which the component 10 is designed to operate is less than 10 MHz. Past this value, it is preferable to add dielectric material 15.

In reference to FIG. 2*d*, in this embodiment, only the interstices 24 are at least partially filled with dielectric material 15.

The inner 18 and outer 19 tabs are able to allow the connection of the component 10 to other elements, for example to an electronic device in which it is integrated.

To that end, the inner 18 and outer 19 tabs are bent relative to the inner turn 161 and the outer turn 162, respectively.

The inner tab 18 is oriented along the axis X-X' and has a length such that it is flush with the upper surface of the component 10.

The outer tab 19 is oriented radially and has a length such that it is flush with the lateral surface of the component 10.

Alternatively, both tabs 18, 19 are oriented along the axis X-X' and are flush with the upper and/or lower surface of the component 10.

The tabs 18, 19 are designed to be placed in contact with an electrically conductive cable (not shown), for example directly or via a metal lacquer attached to the component 10 that makes it possible to facilitate the placement of the cable in contact with the tabs 18, 19.

FIGS. 3*a* to 3*c* illustrate three separate embodiments of an alternative of the component 10 according to the invention, and in which, in addition to the elements already described in the embodiment of FIG. 1, the component 10 comprises a second coil 14B.

The second coil 14B is at least partially embedded in the ferrite of the base 12.

The second coil 14B is substantially comprised in a discoid edge $T_B$ of the component 10 parallel to the edge T and spaced away therefrom, such that the two sections T and $T_B$ define a layer C between them with thickness c of the component 10.

Figure 3:
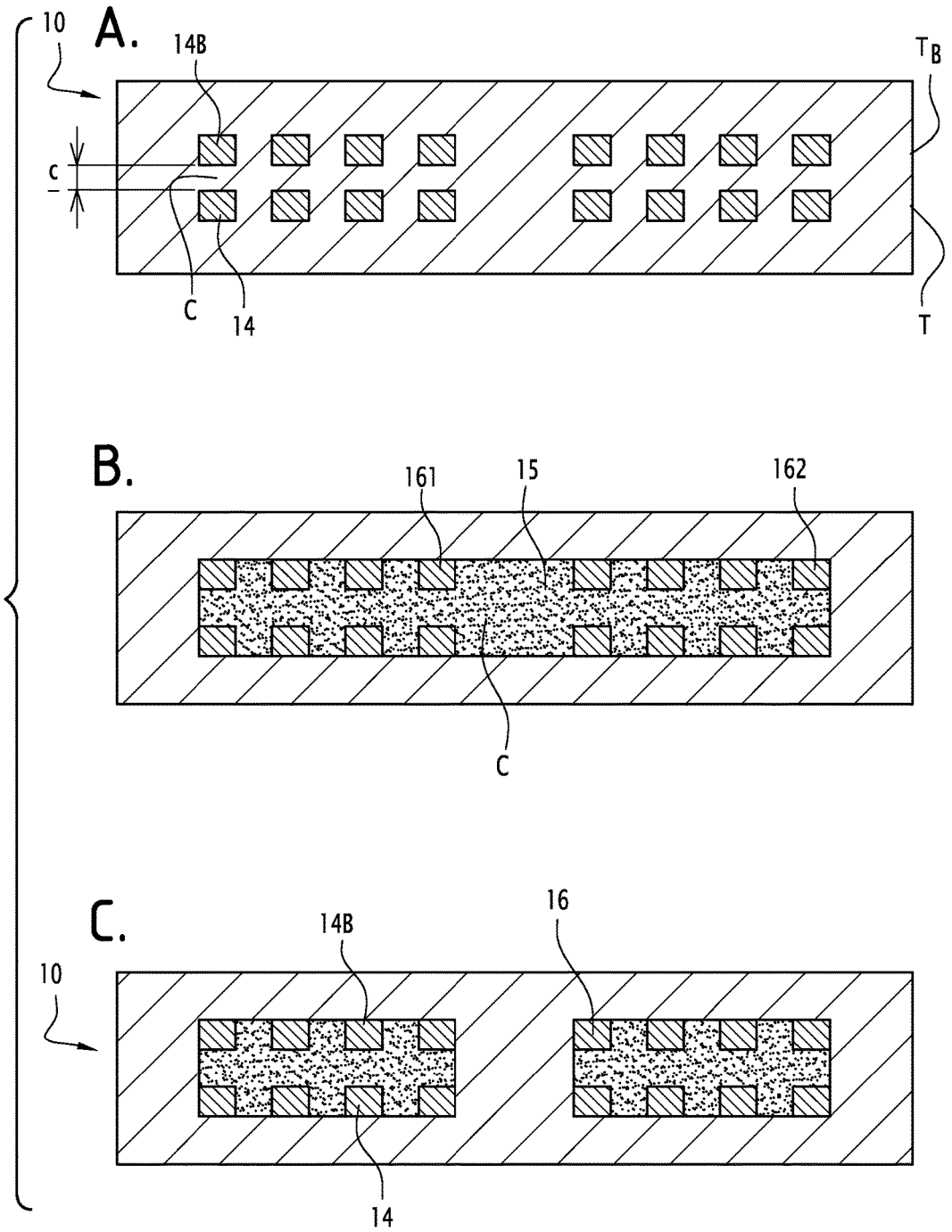
FIG. 3 shows sectional views of a monolithic electromagnetic component comprising two coils according to several embodiments of the invention.

In the example of FIG. 3, this coil 14B has substantially the same structure and dimensions as the coil 14.

Alternatively, the second coil 14B has a number of turns different from the number of turns of the coil 14. This alternative is advantageously implemented to modify the behavior of the coils 14, 14B with similar operating conditions.

In the example of FIGS. 3*b* and 3*c*, the component 10 is a transformer or a magnetic coupler whereof the two coils 14, 14B are magnetically coupled and electrically insulated.

In this alternative, during the operation of the component 10, the current entering one of the coils 14, 14B results in a current leaving through the other coil and magnetically induced therein.

The value of c is then predetermined based on criteria known by those skilled in the art, such as the desired value of the inductance of the coils, the mutual inductance and the coupling coefficient between the coils.

Thus, the value of c is comprised between 100μm and 1 mm.

When the component 10 is a transformer, a value of c close to 100μm is preferable. Conversely, when the component 10 is a magnetic coupler, a value of c close to 1 mm is preferable.

In the example of FIGS. 3*b* and 3*c*, the layer C is at least partially filled with dielectric material 15.

In the example of FIG. 3*b*, only a portion of the layer C centered on the axis X-X', with thickness c and diameter substantially equal to the diameter of the outer turn 162 of the coil 14, is filled with dielectric material 15.

This embodiment is advantageously implemented in order to limit the stray capacitances that may appear between the respective turns 16 of the two coils 14, 14B during the operation of the component 10, or when it is desirable to modify the topology of the magnetic field of each of the turns 161.

In the embodiment of FIG. 3*c*, only a portion of the layer C centered on the axis X-X' and radially defined on the one hand outwardly by the position of the outer turn 162 of the coil 14, and on the other hand inwardly by the position of the inner turn 161 of the coil 14, is filled with dielectric material 15.

This embodiment is advantageously implemented so as to optimize the coupling between the coils, for example when the component 10 is a magnetic coupler, and to limit the leakage fields that may appear during the operation of the component 10.

In the embodiment of FIG. 3*a*, the component 10 does not comprise dielectric material 15. The two coils 14, 14B are completely embedded in the ferrite of the base 12.

This embodiment is advantageously used when it is desirable not to alter the magnetic field resulting from the circulation of the current in each of the turns 161.

Alternatively (not shown), in addition to the elements already described in the embodiments of FIGS. 3*b* and 3*c*, the component 10 comprises at least two metal layers parallel to the coils 14, 14B.

Two successive metal layers are then separated by a layer at least partially filled with dielectric material 15.

Figure 4:
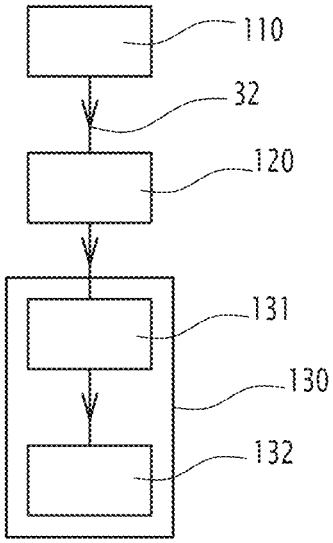
FIG. 4 is a diagrammatic illustration of a method according to the invention.

The manufacturing method 30 according to the invention for producing the component 10 made from a ferrite with general composition (G), and preferably with composition (1), will now be described in reference to FIG. 4.

First, during an initial step 110, a precursor 32 of the ferrite is obtained that will make up the base 12 of the component 10.

The precursor 32 is a ferrite powder obtained by alternating successive grinding and calcination operations of a mixture of nanometric oxides, said calcination being done at a temperature substantially comprised between 600° C. and 1100° C., preferably substantially equal to 760° C.

For a ferrite with composition (1), the precursor 32 is a ferrite powder obtained by alternating successive grinding and calcination operations of a mixture of nanometric oxides of zinc ZnO, copper CuO, nickel NiO, cobalt $Co_3O_4$ and iron $Fe_2O_3$, said calcination being done at a temperature substantially comprised between 600° C. and 1100° C., and preferably substantially equal to 760°.

The grinding operations are intended to decrease the diameter of the oxides, and thus to decrease the sintering temperature of the obtained ferrite powder.

The calcination operations are intended to form the spinel phase of the ferrite, i.e., to transform the basic oxide mixture into a single phase with a spinel structure.

A phase refers to a crystallographic structure.

During the grinding operations, undesirable iron additions may occur or be done through the tools used, such as steel beads.

The initial step 110 then comprises compensating these unwanted additions in the obtained mixture, for example by forming an excess of iron oxide of approximately 5%, for instance.

In some embodiments where the iron flaw δ is not zero, the initial step 110 also comprises suppressing the corresponding quantity of iron of the precursor 32. This makes it possible to ensure the absence of $Fe^{2+}$ that could appear following a slight reduction during sintering (related to the presence of carbon) or an addition of iron during grinding. It should be noted that the presence of $Fe^{2+}$ must be avoided because it greatly increases the conductivity of the ferrite, which would produce additional losses by Foucault currents during the operation of the component. Consequently, preferably, the element A of the general formula of the ferrite is not iron or does not contain iron.

At the end of this initial step 110, the obtained precursor 32 is a ferrite powder whose composition obeys general formula (G), preferably formula (1), and the spinel phase of which is formed.

During a following preparation step 120, the elements of the component, including the coil(s) 14 and other than the ferrite, are embedded in the precursor 32 of the ferrite in a mold 34.

The progression therefore varies slightly depending on the structure of the component 10 one wishes to obtain.

Figure 5:
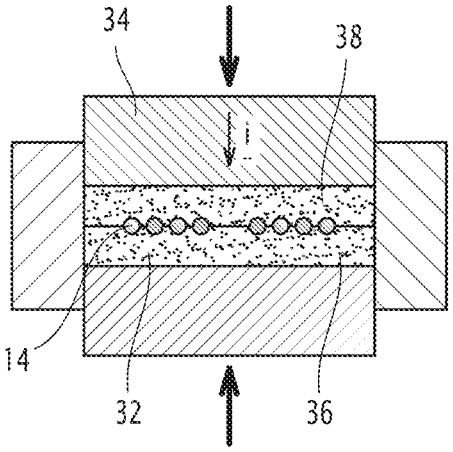
FIG. 5 is a diagrammatic illustration of a step of the method of FIG. 4.
Figure 2:
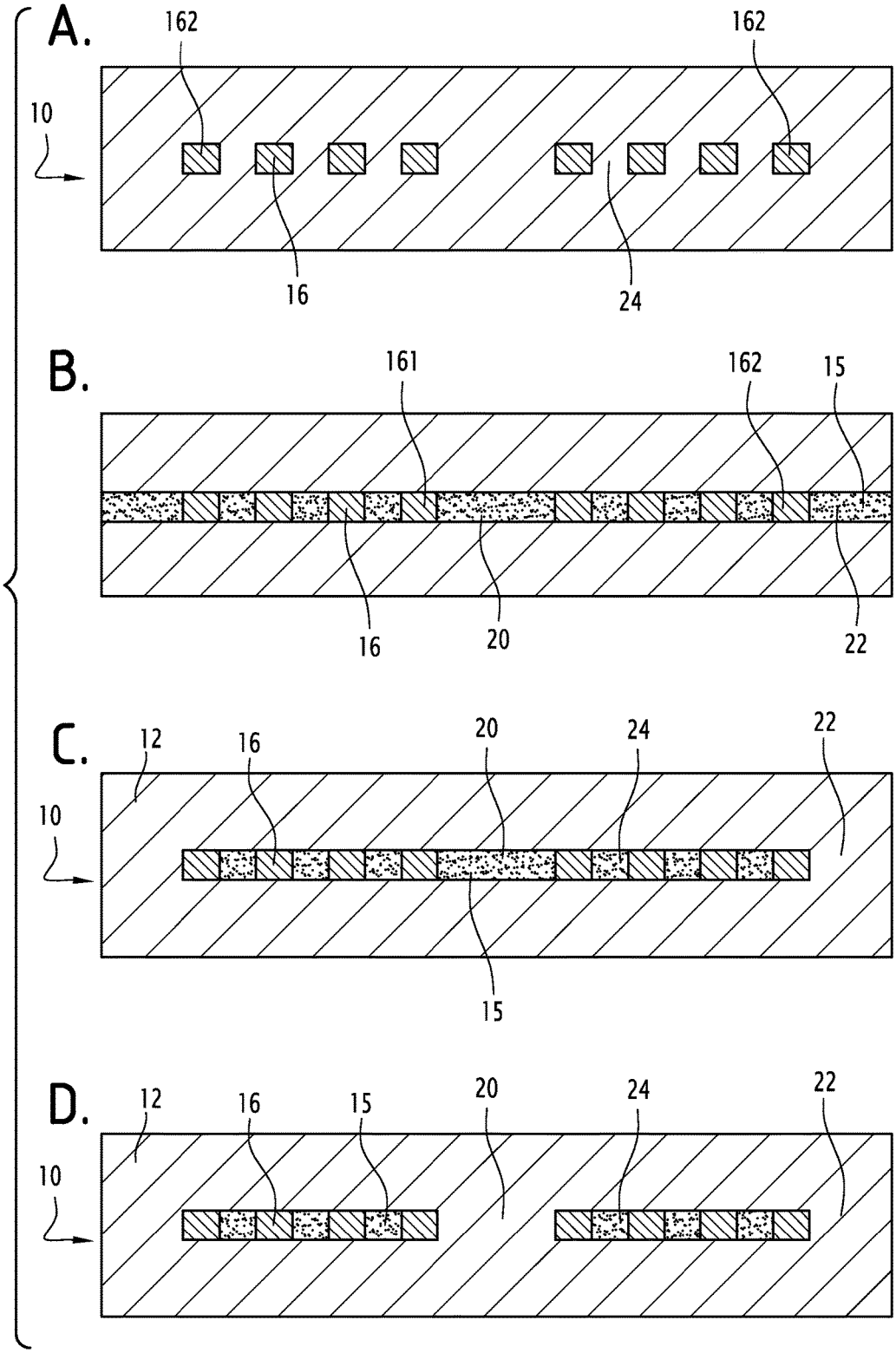
FIG. 2 shows a sectional view of a monolithic electromagnetic component comprising a single coil according to several embodiments of the invention.

More specifically, in reference to FIGS. 2 and 5, for a component with a single coil 14 and not comprising dielectric material 15, a first layer 36 of precursor 32 is deposited in the mold 34, on which the coil 14 is next deposited. A second layer 38 of precursor 32 is then deposited on the coil 14, so as to obtain the desired component structure and dimensions, the elements of the component 10 not yet being secured to one another.

For a component with a single coil 14 comprising dielectric material 15, after having deposited the coil 14 on the first layer 36 of precursor 32, the dielectric material 15 is deposited on the coil 14 and the first layer 36, with the exception of at least the locations of the turns 16 of the coil 14, so as to form the desired structure of the edge T (FIGS. 2*b*, 2*c* and 2*d*). Lastly, a second layer 38 of precursor 32 is deposited, so as to obtain the desired general structure of the component 10, the elements not yet being secured to one another.

For a component 10 comprising two coils 14, 14B and dielectric material 15, after the first layer 36, a layer of dielectric material 15 is deposited so as to form the desired structure of the edge T and the layer C, then the second coil 14B is deposited. A second layer of dielectric material is next deposited with a thickness substantially equal to e with the exception of at least the locations of the turns 16 of the second coil 14B, so as to form the desired structure of the edge $T_B$. The second layer 38 of precursor 32 is deposited last.

For a component 10 with two coils 14, 14B not comprising dielectric material, during step 120, the deposition of the layers of dielectric material 15 described above is then replaced by the deposition of precursor layers 32.

This preparation step 120 is preferably done in a controlled environment, for example a sealed hood, which result in limiting the presence of stray particles that may become deposited in the mold and thus decrease the quality of the obtained component 10.

This step 120 is for example done manually, or automatically using any appropriate device.

The mold 34 is preferably made from graphite. Alternatively, it is made from metal or a refractory metal alloy, or electrically conductive ceramic.

Following this preparation step 120, during a co-sintering step 130, the precursor 32 is secured to the ferrite with the other elements of the component 10 by co-sintering under a load by a pulsed electric current. "Under a load" means that the elements of the component are subjected to a force, in particular an axial force tending to compress the components 10.

During a compression step 131 of this co-sintering step 130, the mold 34 obtained by the preparation step 120 is placed under a neutral gas, and it is subjected to a uniaxial pressure comprised between 50 and 100 MPa. This pressure is shown by arrows in FIG. 5. This pressure is maintained until the end of the co-sintering step 130.

Alternatively, the mold 34 is placed under vacuum or under oxygen.

Next, during a discharge step 132 of this step 130 and which corresponds to co-sintering by pulsed electric current strictly speaking, an electric current is discharged through the mold 34 with a controlled intensity i comprised between 1 A and 20,000 A, and preferably between 1 A and 1,000 A or between 1 and 10 A per square millimeter of component surface. This makes it possible to raise the temperature in the mold 34 and to secure the elements of the component 10 to one another. The temperature inside the mold 34 is controlled by checking the intensity of the current.

The discharge step 132 comprises a co-sintering plateau, during which the temperature inside the mold 34 is kept between 650° C. and 850° C., and preferably between 700° C. and 800° C. The co-sintering plateau has a length comprised between 1 min. and 30 min.

The progression of the discharge step 132 is as follows. The temperature is initially brought to a speed of approximately 100° K per minute, from the ambient temperature, to a value comprised between the above values. The co-sintering plateau is then done. Next, the temperature inside the mold 34 is quickly decreased by interrupting the current. As previously indicated, the uniaxial pressure resulting from the compression step is maintained during the discharge step 132.

The average duration of the discharge step 132 is comprised between 10 min. and 60 min., and advantageously is substantially equal to 20 minutes.

This discharge step 132 is preferably done automatically, via a programmable device suitable for checking the temperature in the mold 34, such that the temperature in the mold 34 is quickly brought to a setpoint temperature and kept at that temperature during the sintering plateaus.

Alternatively, the precursor 32 obtained at the end of the initial step 110 is a mixture of nanometric oxides corresponding to general formula (G), preferably to formula (1), and the spinel phase of which is not formed.

In order to obtain this precursor 32, during the initial step 110, the different oxides are weighed, then mixed, then the obtained mixture is ground order to mix these oxides and decrease their diameter. As before, the iron contribution due to the grinding tools must then be compensated. No calcination occurs during this step, unlike the previously described embodiments.

The following steps of the method 30 remain the same, with the exception of the discharge phase 132 during which a first reaction plateau is observed. The function of the first reaction plateau is to carry out the formation of the spinel phase of the precursor 32. This first reaction plateau is done at a temperature comprised between 400° C. and 600° C. The first reaction plateau is prior to the co-sintering plateau.

The method 30 according to this alternative is called reactive sintering, during which the mixture of ground oxides transforms into a spinel phase during the discharge phase 130, unlike the method 30 described above, which is called direct sintering and in which the precursor 32 is a ground and calcinated ferrite powder and the spinel phase of which is already formed at the end of the initial step 110.

This alternative of the method 30 has several advantages:

- it is no longer necessary to perform calcination operations during the initial phase 110, such that the method 30 according to this alternative is simplified, the spinel phase of the ferrite forming directly during the discharge phase 132,
- it makes it possible to obtain soft magnetic cores for high frequencies and very high frequencies from sintering done at a temperature below that of the known methods.

Alternatively (not shown), during the initial step 110, the precursor 32 with general formula (G), preferably formula (1), is obtained chemically, the initial steps 110 of the direct and reactive sintering methods described above corresponding to so-called solid methods. This alternative makes it possible to obtain a ferrite with a more homogenous composition and having a closer particle size distribution than by using the solid method.

The precursor 32 obtained through the chemical method is then a ferrite powder with general composition (G) whereof the grains are mixed spinel particles. For a ferrite powder with formula (1), the simple spinel particles are for example Fe3O4, NiFe2O4, CoFe2O4 or particles with a more complex composition, for example with composition (1).

The initial step 110 according to the chemical method is then done using one of the three following protocols:

- Synthesis by co-precipitation, which consists of the precipitation of aqueous solutions containing the metal ions at a controlled concentration to form the targeted composition ferrite. The precipitation kinetics are slow and the phase that precipitates is amorphous. The size of the obtained nanoparticles is comprised between 5 nm and 7 nm.
- Synthesis by sol gel, which consists of the hydrolysis of alkoxide solutions with formula Me(OR)n in alcoholic medium. Colloidal solutions are obtained where the nanoparticles are kept in suspension with a size of approximately 5 nm, which is next precipitated.
- Hydrothermal synthesis, which consists of dissolving precursor compounds (or intermediate derivatives) of the precursor 32 itself, followed by a precipitation of the obtained solutions. Hydrothermal synthesis differs from the other protocols by the temperature and pressure conditions implemented, and is done at temperatures comprised between 90° C. and 500° C. in a reactor under a pressure of approximately several tens of atmospheres. This hydrothermal synthesis is advantageous because it produces very fine powders that are weakly agglomerated and well crystallized. Furthermore, it occurs at a relatively low temperature, the ferrite powders can be obtained in the soft state, i.e., have a specific magnetization with a high saturation and low coercive field, the characteristics of the synthesized particles are easy to check by checking the conditions of the reaction (temperature, duration, etc.), and the obtained ferrite powder is adapted to be sintered at a low temperature while producing a massive and dense material.

Based on the reaction conditions and the selected synthesis protocol, the precursor of the precursor 32 obtained at the end of the protocol may not have a formed spinel phase, or have a partially formed spinel phase.

In this case, the initial step 110 comprises an additional calcination phase seeking to form the spinel phase of the precursor 32, such that the precursor 32 obtained at the end of step 110 has a formed spinel phase.

Also alternatively, during the initial step 110, the precursor 32 is obtained by the so-called "polyol" route, during which simple acetate, nitrate and chloride compounds are dissolved in liquid polyols, such as 1,2-propane diol, 1,2-ethane diol and bis(2-hydroxy ethyl) ether. Due to their relatively high dielectric constant, which allows them to dissolve inorganic solids, these polyols constitute mediums favorable to obtaining various inorganic materials: metals, hydroxides and oxides. Complexes comprising alkoxy groups then form, from which oxides and hydroxides are obtained by hydrolysis and polymerization.

The competition between these reactions can be checked by regulating the hydrolysis rate and the reaction temperature. Checking the germination and growth steps makes it possible to obtain nanometric, sub-micronic and micronic particles having optimized properties from which the precursor 32 is obtained.

As before, based on the conditions for carrying out the initial step 110 by the polyol method, the precursor of the obtained precursor 32 may not have a formed spinel phase, or may have a partially formed spinel phase.

In this case, the initial step 110 comprises an additional calcination phase seeking to form the spinel phase of the precursor 32, such that the precursor 32 obtained at the end of step 110 has a formed spinel phase.

In summary, the precursor 32 with general formula (G), preferably formula (1), obtained at the end of the initial step 110 is:

- a ferrite powder having a formed spinel phase obtained by alternating successive grinding and calcination operations of a mixture of nanometric oxides, and is obtained by the solid method, or
- a mixture of nanometric oxides not having a spinel phase and obtained by the solid method, or
- a ferrite powder having a formed spinel phase and is obtained by the chemical method by co-precipitation synthesis, by Sol-gel synthesis or by hydrothermal synthesis, or
- a ferrite powder having a formed spinel phase and is obtained by the polyol method.

The Applicant has implemented the method 30 described above successfully and obtained, inter alia, an example component 10 whereof the ferrite with composition $Ni_{0.195}Cu_{0.2}Zn_{0.5999}Co_{0.006}Fe_2O_4$ was co-sintered with a copper coil 14 by direct sintering under a uniaxial pressure of 50 MPa, under argon, and at a temperature between 650° C. and 800° C.

The component 10 that was obtained has a magnetic moment at saturation equal to 54 $A \cdot m^2/kg$ and a relative density greater than 90%.

The method 30 according to the invention makes it possible to perform the co-sintering of ferrites with metals other than noble metals, such as silver Ag or Palladium Pd. In particular, it makes it possible to produce monolithic components having one or more coils made from copper, which the known methods do not allow.

Indeed, the conventional sintering methods require the prolonged exposure, for durations sometimes up to several days, of the elements of the component to temperatures relatively close to the melting temperature of copper.

This results in causing diffusions of the copper in the ferrite, which damages the obtained compositions or even makes them unusable.

The components obtained using the method according to the invention are therefore less expensive.

Furthermore, because it has only a small number of steps, the method 30 decreases the risks of occurrence of a manipulation error of the elements of the material, or damage to them during transportation between the premises where they respectively take place, such that the method according to the invention is globally safer and less expensive than the known methods for producing this type of electronic components.

Furthermore, the method according to the invention does not have any particular susceptibility to the dimensions of the desired components, unlike the methods such as the so-called LTCC (Low Temperature Cofired Ceramic) method, which can only produce small components (maximum 10 mm in diameter and 2 mm thick, with larger dimensions resulting in delamination and cracks), such that the only limitations of the method 30 are due to the limitations intrinsic to the materials used.

The components 10 obtained using such a method 30 are not subject to any oversizing required by any limitations related to their production method, and have a compactness of 100%.

Furthermore, the obtained electromagnetic components have a closed magnetic structure that completely confines the magnetic flow and prevents these components from radiating and interfering with the adjacent components, such that the integration of the components 10 obtained using the method 30 is made easier.

Conversely, a method like LTCC, which only makes it possible to produce small components, makes it very difficult to manufacture components with a confined magnetic flow, the obtained components proving complex to integrate.

Figure 6:
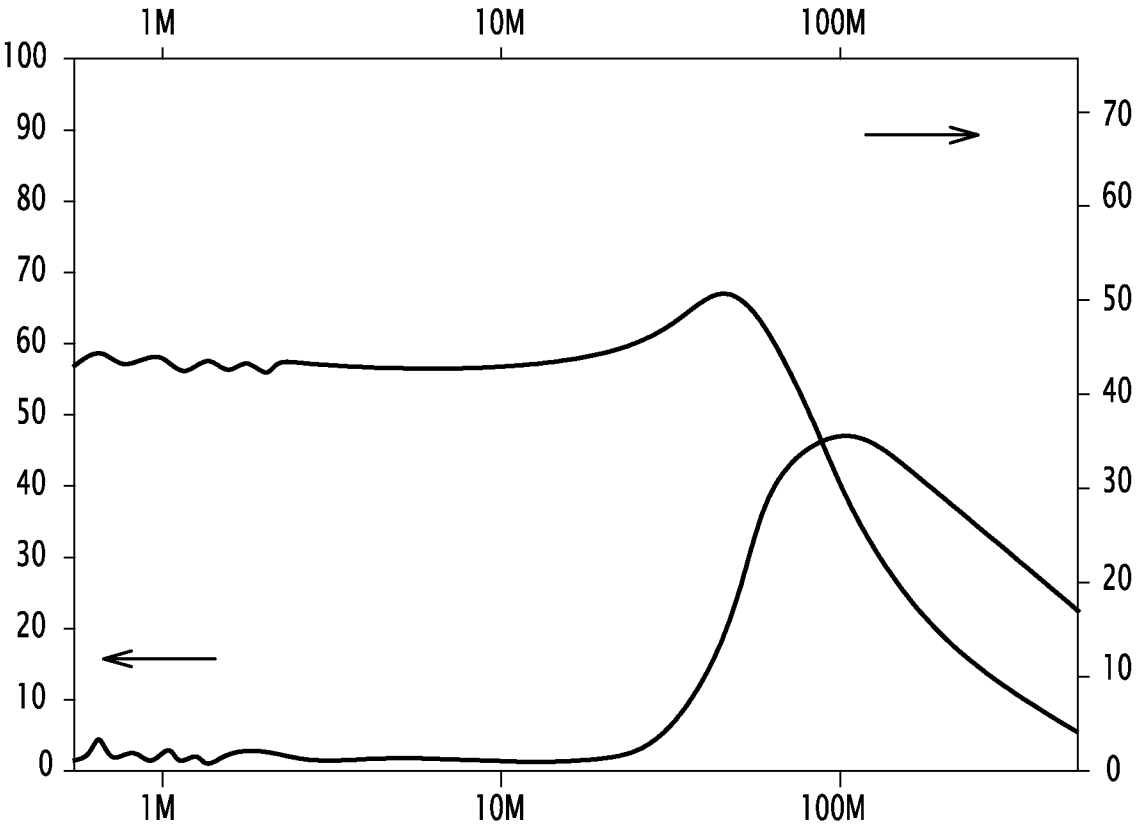
FIG. 6 is a diagrammatic illustration of the complex permeability spectrum of an electromagnetic component made using a production method according to the invention.

In reference to FIG. 6, which illustrates the complex permeability spectrum as a function of the frequency of the electromagnetic component 10 obtained using the reactive sintering method 30 according to the invention with its real part, μ', identified on the left scale and its imaginary part, μ", on the right scale, one sees that the initial permeability is close to 120 up to a frequency $f_r$ equal to 10 MHz and decreases past that point. The imaginary permeability μ" is less than 0.01 up to 2 MHz and increases past that point up to a resonance frequency $f_r$ equal to 30 MHz. Thus, the figure of merit $\mu'*f_r$ is equal to 6.6 GHz.

Figure 7:
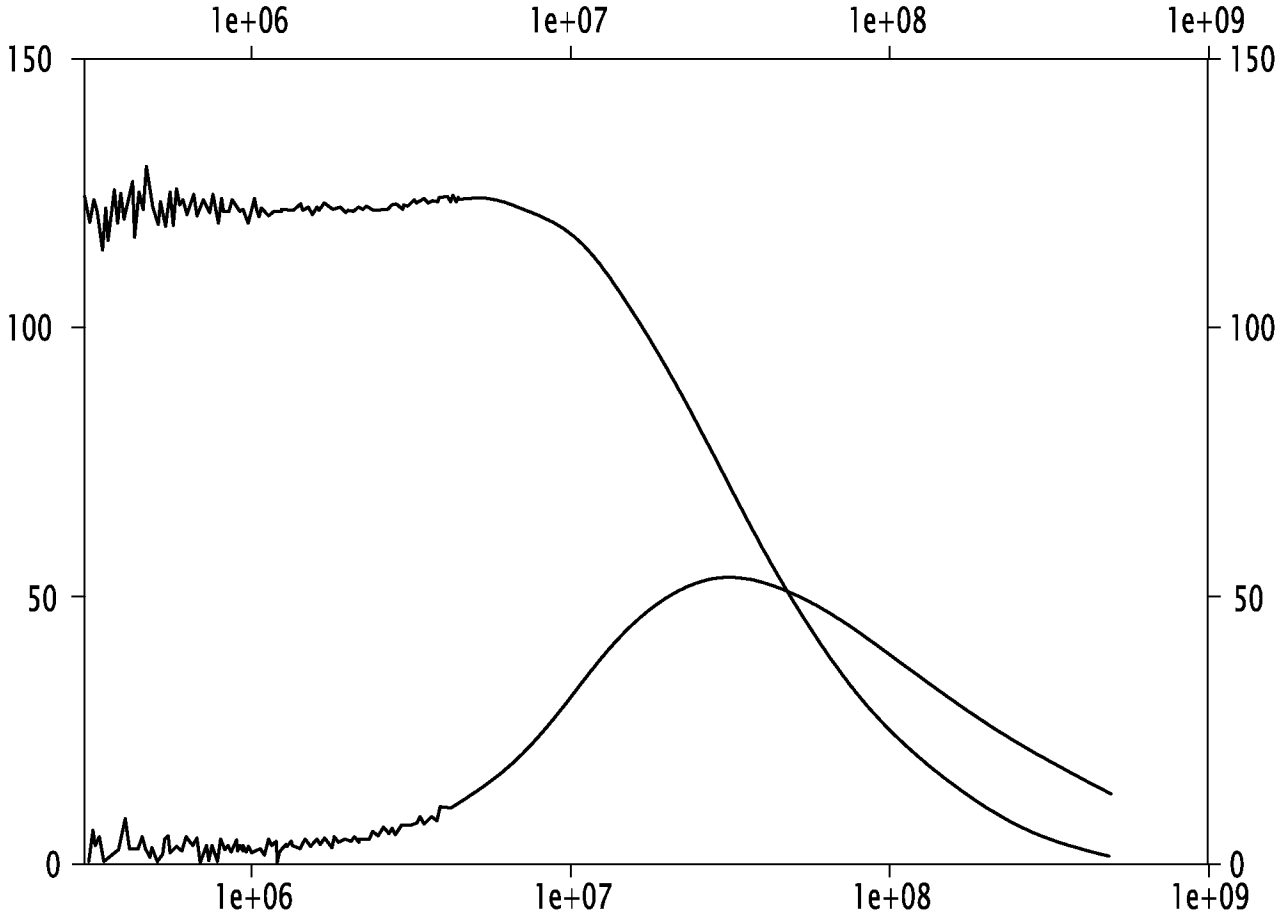
FIG. 7 is an illustration of the complex permeability spectrum of a ferrite of an electromagnetic component made using an alternative of a production method according to the invention.

In reference to FIG. 7, which illustrates the complex permeability spectrum as a function of the frequency of a ferrite of a component 10 according to the invention and produced using the direct sintering method 30 according to the invention with its actual permeability identified on the left scale and its imaginary permeability identified on the right scale, one sees that the initial permeability μ' is close to 60 up to a frequency equal to 10 MHz, and increases up to 67 for a frequency equal to 50 MHz and decreases past that point. The imaginary permeability μ" is less than 0.01 up to 10 MHz and increases past that point up to a resonance frequency fr equal to 100 MHz. Thus, the figure of merit $\mu'*f_r$ is equal to 6 GHz.

Figure 8:
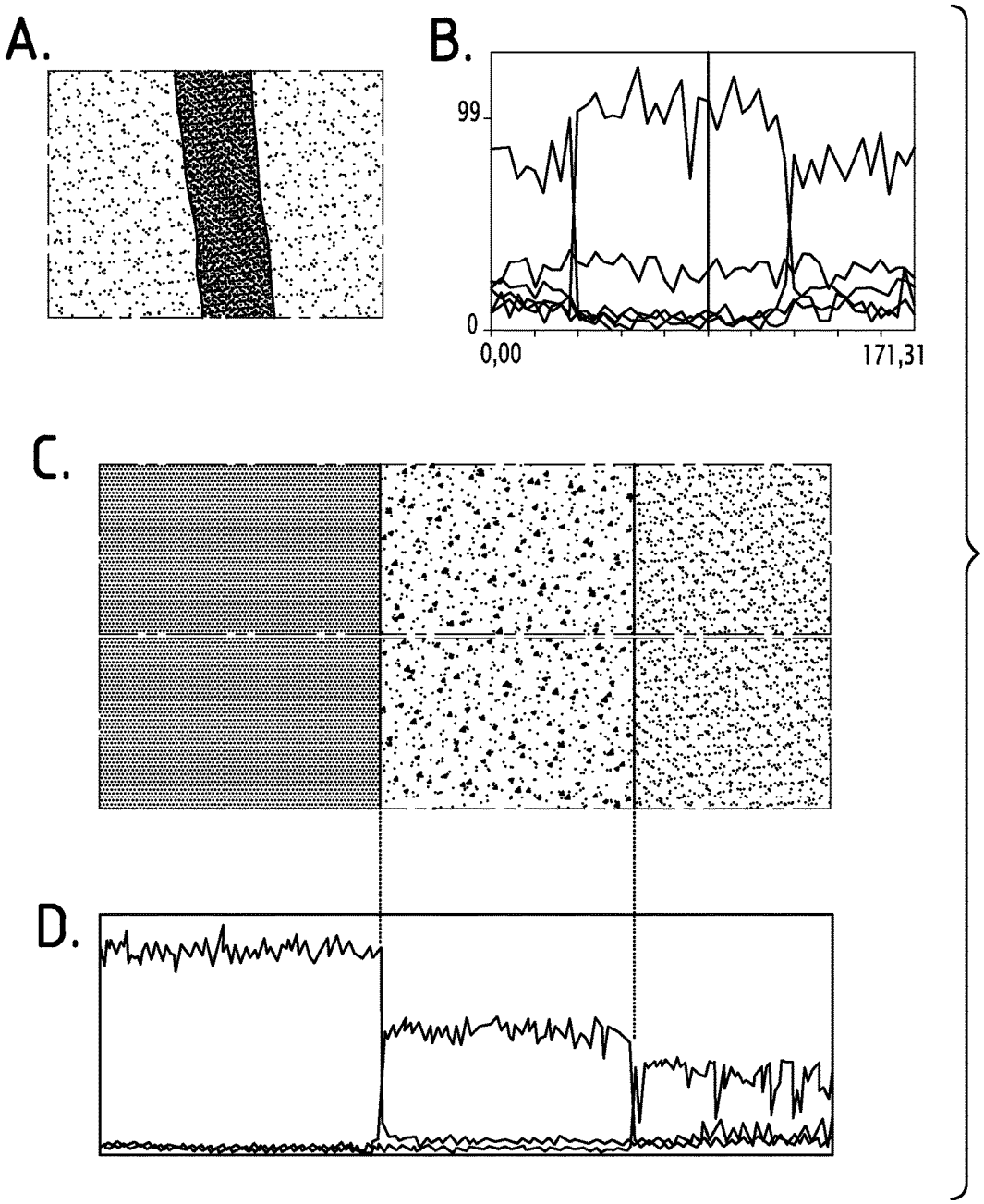
FIG. 8 is a diagrammatic illustration of the micrography by scanning electron microscope, as well as the EDS analysis of the interface between a coil and the ferrite of a monolithic electromagnetic component according to the invention.

In reference to FIG. 8, whereof FIG. 8*a* illustrates the scanning electron microscope (SEM) micrography of the ferrite/copper interface of a component 10, and whereof FIG. 8*b* illustrates the EDS analysis of the interface between a coil 14 and the ferrite of that component 10, one sees according to FIG. 8*a* that the mechanical strength after co-sintering is satisfactory. The interfaces are regular and do not show delamination or cracks.

FIG. 8*b* shows that the border between the two elements is completely visible. The copper sheet remains located between the two layers of ferrite and is found over a thickness of 100μm. In light of this FIG. 8*b*, we can therefore conclude that the co-sintering is completely successful between the copper and the ferrite of the obtained component 10.

FIG. 8*c* shows the micrography of the $BaTiO_3$/Cu interface observed by SEM, and FIG. 8*d* shows the EDS analysis of that interface.

One can see good mechanical strength of the co-sintered part and a regular interface between the different materials. The copper remains well confined between the dielectric and ferrite layers. Furthermore, there are none of the elements of the dielectric in the layer of copper and conversely, there is no copper in the dielectric. This indicates that there has not been any diffusion between the various elements of each layer on the micron scale.

In reference to FIG. 9, which shows, as a function of the frequency, the series $L_s$ inductance in thick lines, and the overvoltage factor Q, in thin lines, of an integrated monolithic inductance made using the method according to the invention at 800° C. for five minutes, under a uniaxial pressure of 50 MPA and under argon, one sees that the series $L_S$ inductance value of this component 10 according to the invention is equal to 3.4 pH up to 10 MHz, the overvoltage coefficient Q being greater than 35 at 1 MHz and being canceled out at 10 MHz.

FIG. 10 shows the measurements of the primary and secondary inductance of a transformer 10 with no dielectric material 15 and operating from 100 kHz to 10 MHz as a function of the frequency. This transformer 10 is made using the production method according to the invention, during which the ferrite material $NiZnCuFe_2O_4$ is co-sintered with a copper coil 14 with a circular spiral shape by direct co-sintering at 800° C. for five minutes under uniaxial pressure of 50 MPA and under argon. The value of the primary and secondary inductance of this transformer 10 is identified on the left scale (in μH) and is close to 1.8 and 2.2 μH up to 10 MHz, the overvoltage coefficient being identified on the right scale and being greater than 25 at 1 MHz and canceling out at 40 MHz.

A component 10 according to the invention comprising a single coil 14 is for example an inductance intended to be used in a filtering device.

A component 10 according to the invention comprising two coils 14, 14B is for example a transformer or magnetic coupler.

What is claimed is:

1. A method for producing a monolithic electromagnetic component, comprising:

preparing a precursor from a ferrite material during an initial step;

preparing elements comprising at least one coil having coil turns;

embedding the elements comprising said at least one coil having the coil turns in the precursor embedded in a mold;

co-sintering the elements comprising said at least one coil having the coil turns and the precursor compressed by the mold under a predetermined pressure, wherein the predetermined pressure is generated under a load, and wherein a pulsed electric current is generated during the co-sintering;

discharging the pulsed electric current through the mold such that a temperature in the mold rises; and obtaining the monolithic electromagnetic component in which said precursor is secured to the elements comprising said at least one coil having the coil turns.

2. The method according to claim 1, further comprising:

preparing said at least one coil from a material including copper.

3. The method according to claim 1, further comprising:

preparing the ferrite material from a composition including a compound represented by the formula $Ni_x Zn_{1-x-y-\varepsilon+\delta}Cu_yCo_\varepsilon Fe_{2-\varepsilon}O_4$, wherein:

$0.15 \leq x \leq 0.6$;

$0 < y \leq 0.2$;

$0 \leq \varepsilon < 0.1$; and $0 \leq \delta < 0.05$.

4. The method according to claim 1, wherein the precursor is made of a ferrite powder having a spinel phase formed and obtained by successive grinding and calcination operation of a mixture of nanometric oxides, said calcination operation being done at a temperature between 600° C. and 1100° C.

5. The method according to claim 1, further comprising:

preparing a mixture of nanometric oxides not having a formed spinel phase to obtain the precursor.

6. The method according to claim 1, wherein said preparation of the elements comprises preparing the elements comprising said at least one coil having coil turns and a dielectric material.

7. The method according to claim 1, wherein the coil turns of the coil have a general circular spiral or a square spiral shape.

8. The method according to claim 1, wherein, in the process of preparing the elements of the monolithic electromagnetic component, a first layer of the precursor is deposited in the mold, then the elements of the monolithic electromagnetic component are arranged, then a second layer of the precursor is deposited in the mold.

9. The method according to claim 1, wherein the co-sintering process further comprising:

compressing the mold under a uniaxial pressure between 50 and 100 MPa; and discharging an electric current with an intensity between 1 A and 20000 A per square millimeter of component surface through the mold, such that a temperature in the mold rises and the elements of the monolithic electromagnetic component become secured to one another.

10. The method according to claim 9, wherein the discharging process comprises co-sintering plateau during which the temperature inside the mold is kept between 650° C. and 850° C., for a duration between 1 min and 30 min.

11. The method according to claim 9, wherein the precursor is a mixture of nanometric oxides not having a formed spinel phase, and the discharge process comprises a first reaction plateau during which the temperature in the mold is between 400° C. and 600° C., and during which the spinel phase of the precursor is formed.

12. The method according to claim 1, wherein the ferrite material is a spinel ferrite and the at least one coil is at least one planar coil.

13. A method for producing a monolithic electromagnetic component, comprising:

preparing a precursor from a ferrite material during an initial step;

preparing elements comprising at least one coil having coil turns;

embedding the elements comprising said at least one coil having the coil turns in the precursor embedded in a mold;

co-sintering the elements comprising said at least one coil having the coil turns and the precursor compressed by the mold under a predetermined pressure, wherein the predetermined pressure is generated under a load, and wherein a pulsed electric current is generated during the co-sintering;

discharging the pulsed electric current through the mold such that a temperature in the mold rises; and obtaining the monolithic electromagnetic component in which said precursor is secured to the elements comprising said at least one coil having the coil turns, wherein the temperature in the mold during said co-sintering is kept between 650° C. and 850° C.

14. The method for producing the monolithic electromagnetic component of claim 13, wherein a period of time during which the temperature in the mold during said co-sintering is kept between 650° C. and 850° C. is between 1 min and 30 min.

* * * * *